United States Patent [19]

Gumb

[11] 4,088,384

[45] May 9, 1978

[54] ADAPTOR FOR PLUG-IN TELEPHONES

[75] Inventor: Beverley William Gumb, London, Canada

[73] Assignee: Northern Telecom Limited, Montreal, Canada

[21] Appl. No.: 745,595

[22] Filed: Nov. 29, 1976

[51] Int. Cl.[2] ..... H01R 31/06

[52] U.S. Cl. ..... 339/156 R; 179/1 PC

[58] Field of Search ..... 339/154 R, 154 A, 155 R, 339/156 R, 157 R, 157 C, 158, 159 R, 159 C, 166 R, 167–170, 176 R, 176 M, 91 R, 99 R; 179/1 PC

[56] References Cited

U.S. PATENT DOCUMENTS

| | | | |
|---|---|---|---|
| 1,676,439 | 7/1928 | Ile | 339/158 |
| 3,761,869 | 9/1973 | Hardesty et al. | 339/99 R |
| 3,812,451 | 5/1974 | Buglewicz | 339/166 R |
| 3,985,412 | 10/1976 | Hoffman | 339/166 R |

*Primary Examiner*—Roy Lake
*Assistant Examiner*—Neil Abrams
*Attorney, Agent, or Firm*—Sidney T. Jelly

[57] ABSTRACT

An adaptor enables telephones using the later type of miniature plugs to be used with the conventional telephone outlet. The adaptor has a housing having pins in the base which plug into the conventional outlet. The cover carries a miniature jack on the inside, the jack in two parts, upper and lower. The lower part is molded integral with the cover and defines a plug-receiving cavity. An aperture in the cover is aligned with this cavity. The upper part of the jack has contacts extending therethrough, the contacts bent down and round to extend rearwards in the cavity for contact by terminals in the jack. The contacts are connected to the pins in the base of the housing.

2 Claims, 4 Drawing Figures

ADAPTOR FOR PLUG-IN TELEPHONES

This invention relates to an adaptor for plug-in telephones, particularly such as are used in residential and similar premises.

Conventionally telephone sets in residential premises are either permanently wired to an outlet in a wall or a special jack is attached to the wall, the jack adapted to accept a four pin plug at the end of the telephone set line cord. It is now being proposed that telephones be provided with cords, both line cords and handset cords, which have miniature plugs at each end, the plugs being capable of insertion and withdrawal at will by the telephone customer. Eventually, residential premises will be prewired and outlets provided as desired.

In the meantime there are many places where the conventional outlets are provided. If a telephone user wishes to make use of the new system, aimed at providing the facility of replacing parts of a telephone, i.e. line cord, handset cord, handset or even the basic set, without the need, and expense of calling in a service representative then it means rewiring by providing new types of outlets or jacks. The present invention enables a telephone user to connect or adapt existing jacks or outlets to take the new miniature plugs.

The invention will be readily understood by the following description in conjunction with the accompanying drawings, in which.

Figure 1:
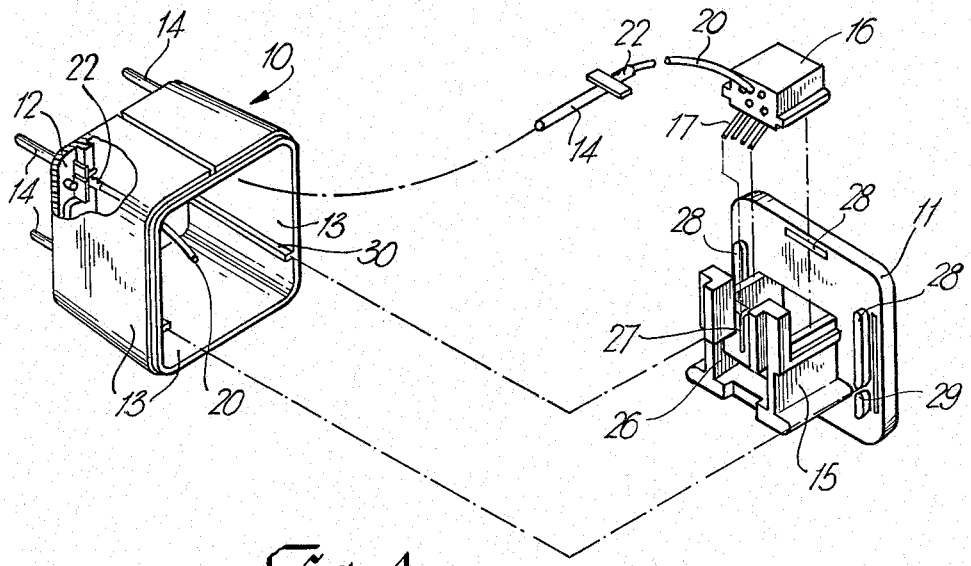
FIG. 1 is a perspective exploded view of an adaptor in accordance with the present invention.

As illustrated in FIG. 1, an adaptor comprises a housing 10 and a cover 11. The base 10 is of an open hollow box like formation having a base 12 and four sides 13 extending from the base. Extending from the base 12 are four pins 14, these pins positioned to fit into the terminals of a conventional jack or outlet.

The cover 11 carries a miniature type jack composed of two parts, a lower part 15 and an upper part 16. The lower part 15 is molded integral with the cover 11 while the upper part 16 is formed separately and attached to the lower part 15, as by bonding or welding. The jack projects from the back of the cover 11 into the interior of the housing 10.

Figure 2:
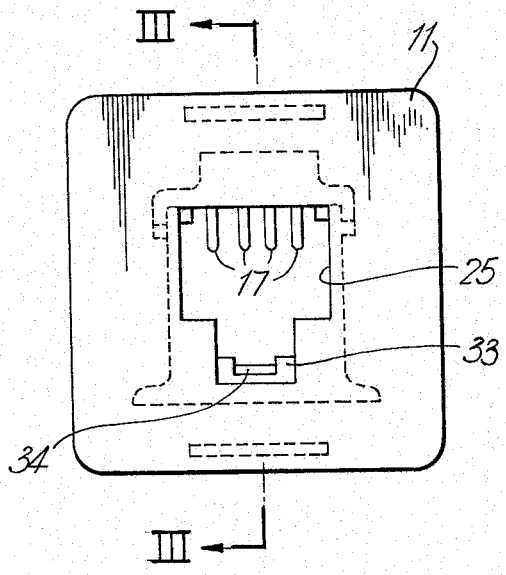
FIG. 2 is a view on the front face of the adaptor of FIG. 1.
Figure 3:
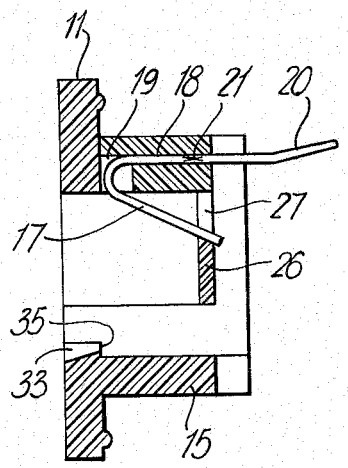
FIG. 3 is a cross-section on the line III—III of FIG. 2.

The upper part 16 of the jack has contacts 17 therein. As seen in FIG. 3, the contacts extend through the holes 18 in the upper part of the jack, the holes connecting with the slots 19 at a forward end of the part 16. The contacts 17 are conveniently of springy material and extend from the holes 18, down through the slots 19 and then are bent backwards. Conductors 20 are attached at one end, as by soldering or crimping, at 21, to the contacts 17.

The conductors 20 are attached at their other ends to the inner ends of the pins 14, as by crimping and indicated at 22 in FIG. 1.

In the cover 11 and aperture 25, forming the access opening for the jack, has a profile to suit a miniature plug. The rear wall 26 of the jack has slots 27 extending down from a top surface, and the contacts 17 are positioned in the slots 27. The slots preload the contacts to particular free positions and it can be arranged that one contact extends downwards more than the others, to make contact with the associated contact in the plug first, before the rest of the contacts make.

The inner surface of the cover 11 has projections 28 formed thereon for correct positioning of the cover on the housing. The projects align the cover and housing and also, gaps 29 in the projections 28 on the side edges of the cover cooperate with ribs 30 on the inside of the housing to ensure that the cover has the correct rotational relationship with the housing, the gaps 29 and ribs 30 being nearer the bottom surface of the housing than the top surface. The cover 11 is attached to the housing 10 by bonding, or suitable method.

Figure 4:
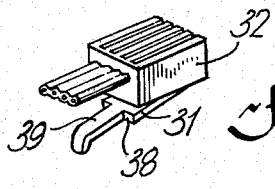
FIG. 4 is a perspective view of a miniature plug, as used with the adaptor.

A plug, as used with the adaptor of the present invention, is provided with a latch which prevents undesired withdrawal of the plug, but which can be actuated by a customer to release the plug, when required. The latch is a resilient cantilever and is generally of the form illustrated in FIG. 4, which is a perspective view of a plug. The latch, indicated generally at 38 has a wide part 31 adjacent the main body 32 of the plug and a narrower tail portion 39. In the jack, at the base of the aperture 25 in the cover, two steps 33 are formed, separated by a groove 34. The steps have vertical rear surface 35. When a plug is inserted, the latch 38 is deflected upward by the steps 33 until the plug is fully inserted, when the wide part 31 of the latch springs down and engages behind the steps. The surface 35 then prevent inadvertent withdrawal of the plug. The tail portion 39 rests in the groove 34. To release the latch, the tail portion pushed up, releasing the wide portion 31 from behind the steps 33. The plug is connected to a line cord 36 and has grooves 37 on its top surface in which are contacts which pierce the conductors of the line cord to make electrical contact therewith, the top surfaces of the contacts making electrical contact with the contacts 17 of the jack.

What is claimed is:

1. An adaptor for connecting a multi-pin telephone outlet to accept a miniature plug, comprising:

a housing having a base and sides extending from said base to form a hollow enclosure, and a plurality of pins attached to and extending from said base in a predetermined pattern to fit into terminals of a conventional multipin telephone outlet;

a cover on said housing and formations on the inner side of said cover, said formations in engagement with said sides to align and orientate said cover on said housing;

a miniature jack on the inside surface of said cover, said jack comprising a lower part integral with said cover and having rear and side walls, and an upper part attached to said lower part, said upper part and said rear and side walls defining a plug receiving cavity;

said upper part having a plurality of holes extending therethrough from a forward face to a rearward face, and a plurality of grooves in said forward face, a groove aligned with each hole, said grooves extending from said holes to said cavity;

a spring wire contact in each related hole and groove, each contact including a first part positioned in the hole, an intermediate part extending substantially normal to said first part and positioned in said groove, and a further part extending rearwards from said groove and extending into said cavity, each contact connected from said first part to an individual and different one of said pins;

slots in said rear wall of said lower part, said slots extending down from a top surface a predetermined distance, said top surface a joint face between said upper and lower parts, and said further part of a contact in each of said slots, said further parts pre-positioned by said slots;

an aperture in said cover aligned with said cavity, said aperture including a base surface including two spaced apart steps having inclined forward surfaces;

whereby a latch member on a miniature plug is deflected over said steps, on insertion of said plug, the latch member engaging behind the steps to prevent inadvertent withdrawal of the plug.

2. An adaptor as claimed in claim 1, one of said slots extending down further than other slots to provide an initial contact between one contact in the adaptor and a related contact in the plug before contact by the other contacts occurs.

* * * * *